United States Patent [19]

Klett

[11] 4,071,967

[45] Feb. 7, 1978

[54] QUICK CHANGE CORNER TOOTH ASSEMBLY FOR LOADER BUCKETS

[75] Inventor: Gene R. Klett, Joliet, Ill.

[73] Assignee: Caterpillar Tractor Co., Peoria, Ill.

[21] Appl. No.: 761,102

[22] Filed: Jan. 21, 1977

[51] Int. Cl.[2] ..... E02F 9/28

[52] U.S. Cl. ..... 37/141 T; 37/142 R

[58] Field of Search ..... 37/141 R, 141 T, 142 R, 37/142 A; 214/145; 172/777

[56] References Cited

U.S. PATENT DOCUMENTS

| | | | |
|---|---|---|---|
| 3,621,594 | 11/1971 | Hahn et al. | 37/141 T |
| 3,748,762 | 7/1973 | Tarrant | 37/141 T |
| 3,812,608 | 5/1974 | Ratkowski | 37/141 T |
| 3,851,413 | 12/1974 | Lukavich | 37/141 T |
| 3,961,788 | 6/1976 | Helton et al. | 172/777 |
| 3,967,398 | 7/1976 | Stepe | 37/141 R |
| 4,007,550 | 2/1977 | Stepe | 37/141 T |

*Primary Examiner*—Ralph T. Rader
*Attorney, Agent, or Firm*—Phillips, Moore, Weissenberger, Lempio & Majestic

[57] ABSTRACT

A loader bucket comprises a pair of laterally spaced end walls and a cutting edge secured forwardly on a bottom wall of the bucket, between the end walls. A corner tooth assembly is detachably mounted on each of the end walls, adjacent to the cutting edge, and comprises an adapter having a forwardly extending adapter portion and an earthworking tip detachably mounted on the adapter portion. The adapter further comprises outer and inner mounting portions straddling the end wall and secured thereto by a single bolt extending transversely therethrough. In a first embodiment of this invention, a pair of first force transmitting surfaces are formed rearwardly on the adapter portion to abut a flat forward edge of the end wall and a bevelled surface of the cutting edge, respectively. A pair of longitudinally spaced second force transmitting surfaces are formed on a bottom portion of the adapter, secured to the outer portion thereof, to abut the underside of the cutting edge. A third force transmitting surface is formed on an underside of the inner portion of the adapter to abut a bearing pad formed integrally on the end wall of the loader bucket. In a second embodiment of this invention, a single force transmitting surface formed on the adapter portion to abut a forward edge of the cutting edge and the adapter portion is maintained out of contact with respect to the forward edge of the end wall.

10 Claims, 5 Drawing Figures

FIG. 3
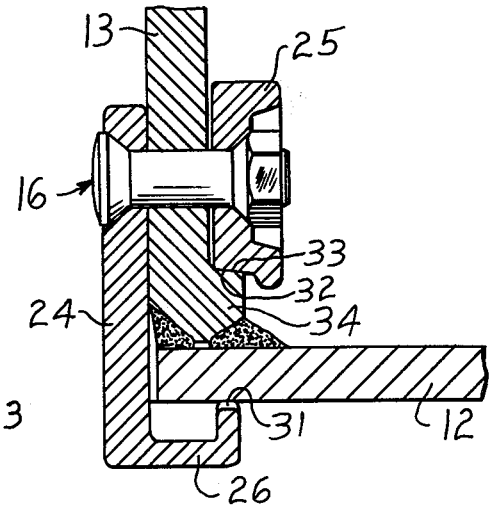
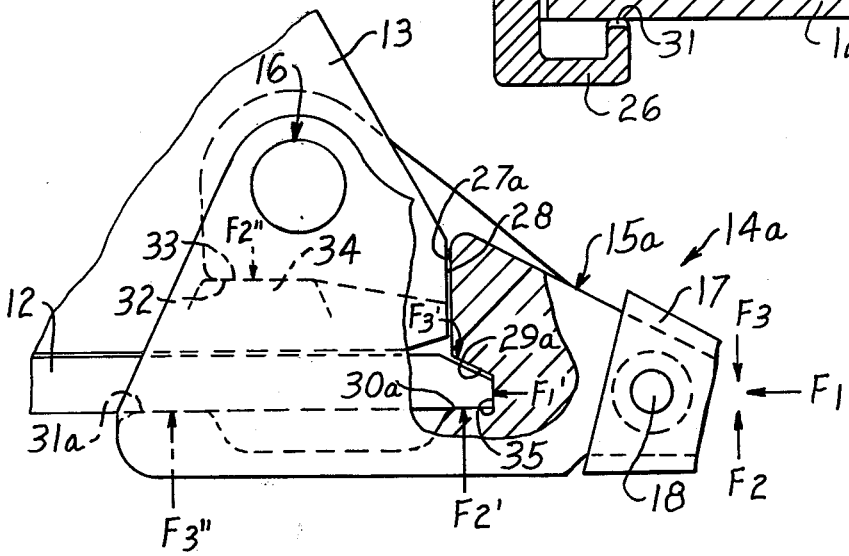
FIG. 5
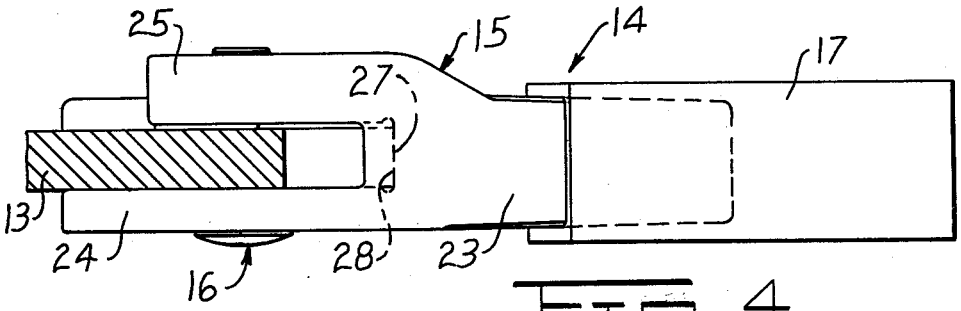
FIG. 4

QUICK CHANGE CORNER TOOTH ASSEMBLY FOR LOADER BUCKETS

BACKGROUND OF THE INVENTION

This invention relates to a corner tooth assembly mounted at each corner of a work implement, such as loader bucket, bulldozer blade or excavator bucket. The loader bucket, for example, comprises a pair of laterally spaced end walls and a forwardly disposed cutting edge secured on a bottom wall of the bucket and disposed between the end walls thereof. Each corner of the bucket, defined at the intersection of each sidewall with the cutting edge, oftentimes has a hardened earthworking tooth mounted thereat to increase the work capabilities of the bucket and to also prolong the service life thereof.

A conventional earthworking tooth is either welded at the corner of the bucket or releasably attached thereto by a plurality of bolts. The welded-on tooth cannot be replaced expeditiously whereas the bolted-on tooth normally requires shear blocks or the like, integrated into the corner construction of the bucket, to alleviate shearing forces imposed on the bolts during bucket operation. Thus, it has proven desirable to seek solutions whereby digging forces are transmitted to the end walls and/or cutting edge of the bucket directly.

SUMMARY OF THIS INVENTION

The present invention is directed to overcoming one or more of the problems as set forth above.

According to the present invention, a quick change corner tooth assembly is provided for a work implement, such as a loader bucket, which will exhibit a high degree of structural integrity and ability to transmit digging forces to the cutting edge and end walls of the work implement directly. The corner tooth assembly comprises an adapter having a forwardly extending adapter portion adapted to detachably mount an earthworking tip thereon. The adapter further comprises a pair of laterally spaced outer and inner mounting portions defining a first slot therebetween and straddling a respective end wall of the work implement. A bottom portion of the adapter is integrally secured to the outer portion thereof and is spaced vertically downwardly from the inner portion to define a second slot for straddling the cutting edge.

In a first embodiment of this invention, first force transmitting means are formed on the adapter portion, at the termination of the first slot and intermediate the outer and inner mounting portions, to abut a forward edge of the end wall and the cutting edge in bearing contact. Second force transmitting means, formed on the outer portion of the adapter, abut an underside of the cutting edge in bearing contact therewith to thus provide for multi-directional transmission of digging forces to the end wall and to the cutting edge of the work implement. In a second embodiment of the invention, the first force transmitting means solely abuts a forward edge of the cutting edge.

In the preferred embodiment of this invention, a single fastening means, such as a bolt, extends transversely through the inner and outer mounting portions of the adapter and through the end wall of the work implement to detachably mount the adapter thereon. In addition, a third force transmitting means is preferably formed on an underside of the inner portion of the adapter to abut a bearing pad formed integrally on the end wall of the bucket.

BRIEF DESCRIPTION OF THE DRAWINGS

Other objects of this invention will become apparent from the following description and accompanying drawings wherein:

FIG. 3 is a sectional view through the corner tooth assembly, taken in the direction of arrows III—III in FIG. 2;

FIG. 4 is a top plan view of the corner tooth assembly, taken in the direction of arrows IV—IV in FIG. 2; and FIG. 5 is a view similar to FIG. 2, but illustrating a modification of the corner tooth assembly.

DETAILED DESCRIPTION

Figure 1:
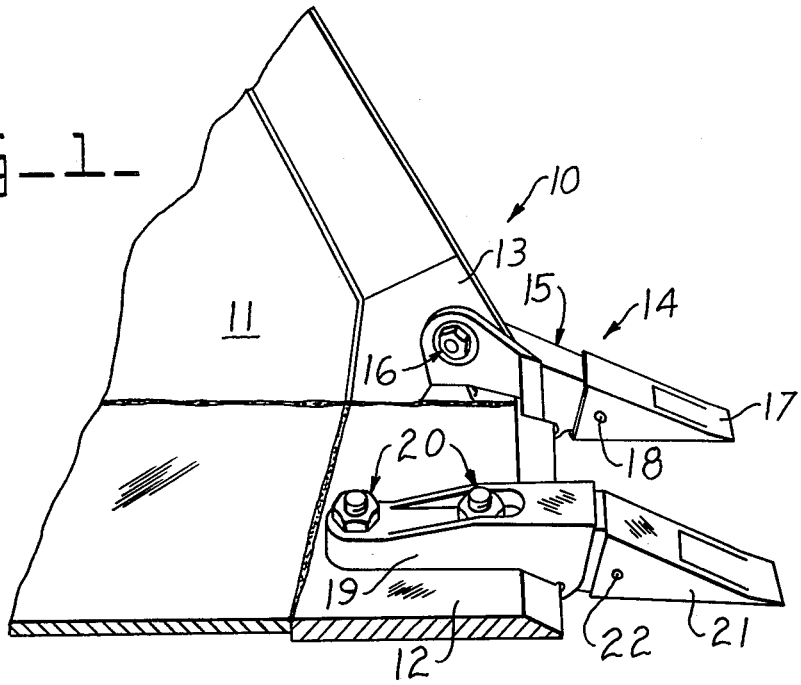
FIG. 1 is an isometric view partially illustrating a loader bucket having the quick change corner tooth assembly of this invention mounted at a corner thereof.

FIG. 1 partially illustrates a loader bucket 10 comprising a pair of laterally spaced end walls 11 (one shown) having a horizontally disposed cutting edge 12 secured forwardly on a bottom wall of the bucket to extend between the end walls. A corner reinforcing plate 13 is secured to the sidewall to form an integral part thereof. Although a corner tooth assembly 14 of this invention is shown mounted on the end wall of a loader bucket, it should be understood that it could likewise be used on other work implements, such as bulldozer blades, excavator buckets and the like.

The corner tooth assembly comprises an adapter 15 mounted on reinforcing plate 13 of the end wall by a single fastening means, such as a bolt 16. A hardened earthworking tip 17 is detachably mounted on the forward end of the adapter by a standard pin assembly 18. Cutting edge 12 may have a plurality of laterally spaced standard adapters 19 (one shown) detachably mounted thereon by bolts 20 with each adapter having a hardened earthworking tip 21 detachably mounted thereon by a standard pin assembly 22.

Figure 2:
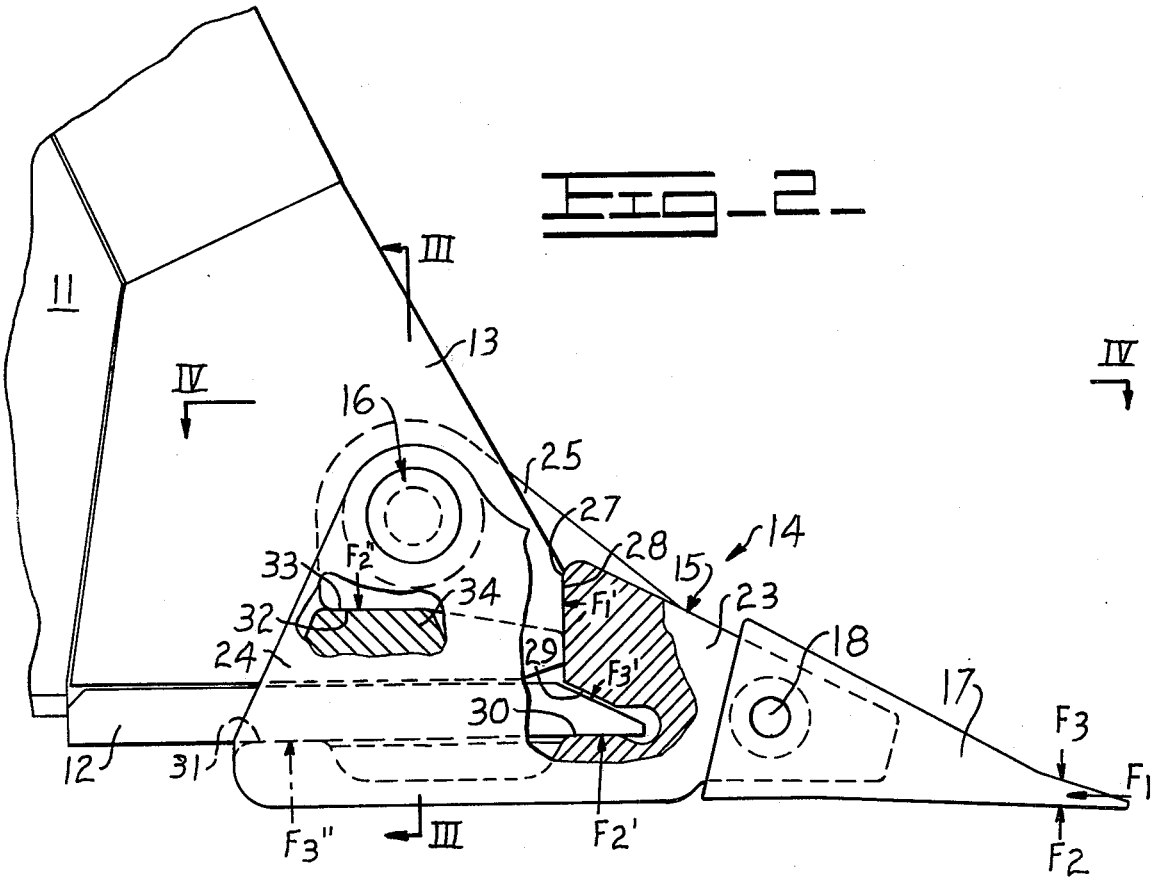
FIG. 2 is an enlarged side elevational view of the corner tooth assembly, partially sectioned for clarification purposes.

Referring to FIGS. 2–4, adapter 15 of the corner tooth assembly comprises a forwardly extending adapter portion 23 having tip 17 mounted thereon. As more clearly shown in FIGS. 3 and 4, the adapter further comprises a pair of laterally spaced outer and inner mounting portions 24 and 25, respectively, which define a first slot therebetween which accommodates reinforcing plate 13 therein. The mounting portions thus straddle opposite sides of the reinforcing plate to prevent lateral movements of the adapter relative to the bucket. It should be noted that bolt 16 extends through aligned apertures formed through mounting portions 24 and 25 and through reinforcing plate 13 of endwall 11.

As shown in FIGS. 2 and 3, the adapter also comprises a bottom portion 26 integrally secured to outer portion 24. Such bottom portion is spaced vertically ownwardly from inner portion 25 of the adapter to define a second slot therebetween which accommodates cutting edge 12 therein. Thus, the adapter is further accommodated at the corner of the bucket to prevent vertical movements of the adapter relative to the bucket.

Referring to FIGS. 2 and 4, a first force transmitting means in the form of a vertically disposed flat first bearing surface 27 engages a flat bearing surface 28 formed on the forward edge of reinforcing plate 13. Bearing surface 27 is disposed at the termination of the first slot formed between inner and outer portions 24 and 25 of the adapter and is further disposed intermediate such portions. It should be noted that the first force transmitting means may further comprise a tapered second bearing surface 29, formed rearwardly on the adapter to intersect bearing surface 27, maintained in bearing contact with the bevelled edge of cutting edge 12.

Referring to FIGS. 2 and 3, a second force transmitting means comprises a pair of longitudinally spaced flat bearing surfaces or pads 30 and 31 formed on the upper side of bottom portion 26 of the adapter. The latter bearing surfaces abut the underside of cutting edge 12 in bearing contact therewith and are spaced longitudinally on opposite sides of bolt 16. As further shown, a third force transmitting means comprises a flat bearing surface 32 formed on an underside of inner portion 25 of the adapter. Bearing surface 32 abuts a flat bearing surface 33, formed on an upper side of a bearing pad 34 formed integrally on an inboard side of reinforcing plate 13.

From the above description, it can be seen in FIG. 2 that horizontal forces $F_1$ imposed on tip 17 and adapter 15 will be transmitted directly to reinforcing plate 13 of the bucket via bearing surface 27 as depicted by force arrow $F_1'$. Upwardly directed forces $F_2$ imposed on the tip will be transmitted directly to cutting edge 12 and bearing pad 34 at bearing surfaces 30 and 33 as depicted by force arrow $F_2'$ and $F_2''$, respectively. Downwardly directed forces $F_3$ imposed on the tip will be transmitted to the cutting edge at bearing surfaces 29 and 31 as depicted by force arrows $F_3'$ and $F_3''$, respectively.

It should be noted in FIG. 2 that bearing surface 33 is disposed intermediate bearing surfaces 30 and 31 in a longitudinal direction along the corner tooth assembly. As suggested above, this arrangement provides that digging forces $F_2$, imposed upwardly on the end of tip 17 to urge adapter 15 in a counterclockwise direction about the axis of bolt 16, will be transmitted to cutting edge 12 and reinforcing plate 13 via bearing surfaces 30 and 33, respectively. Forces $F_3$ imposed on the tip in an opposite, downward direction, such as during a prying operation, will tend to pivot the adapter clockwise about the bolt whereby bearing surfaces 29 and 31 will transmit such forces to the cutting edge directly.

Thus, bolt 16 will not be subjected to digging or prying forces imposed on corner tooth assembly during operation of the bucket. It should be further noted that the corner tooth assembly can be removed from the bucket expeditiously by merely removing single bolt 16.

FIG. 5 illustrates a modification 14a of the corner tooth assembly wherein identical numerals depict corresponding constructions, but with numerals appearing in FIG. 5 to depict modified constructions being accompanied by an "*a*". The modified assembly essentially differs from assembly 14 in that surfaces 27a and 29a of modified adapter 15a are maintained out of contact with respect to bearing surface 28 and cutting edge 12, respectively and a bearing surface 35 of the adapter, defined in a notch formed rearwardly on the adapter, is maintained in bearing contact with a leading flat edge of the cutting edge.

Thus, horizontal forces $F_1$ imposed on tip 17 will be transmitted directly to the cutting edge via first force transmitting means or flat bearing surface 35, as depicted by force arrows $F_1'$. As in the FIG. 2 embodiment, upwardly directed forces $F_2$ will be transmitted to the cutting edge and reinforcing plate 13, as depicted by force arrows $F_2'$ and $F_2''$. Downwardly directed forces $F_3$ will be transmitted to the reinforcing plate and cutting edge, as depicted by force arrows $F_3''$ and $F_3'$.

The embodiments of the invention in which an exclusive property or privilege is claimed are defined as follows:

1. A work implement comprising a pair of laterally spaced end walls each defining a surface on a forward edge thereof, a horizontally disposed cutting edge having a forward edge and extending between said end walls and secured forwardly on said work implement, a corner tooth assembly detachably mounted on an end wall of said pair of end walls comprising an adapter having a forwardly extending adapter portion, an earthworking tip detachably mounted on said adapter portion, a pair of laterally spaced outer and inner mounting portions formed integrally with said adapter and defining a first slot therebetween and straddling said end wall, whereby said end wall is accommodated in said first slot, a bottom portion integrally secured to said outer portion and spaced vertically downwardly from said inner portion to define a second slot therebetween, said cutting edge disposed in said second slot, first force transmitting means, formed rearwardly on said adapter portion, abutting at least one of the forward edge of said end wall and/or said cutting edge in bearing contact therewith, second force transmitting means formed on said outer portion and abutting an underside of said cutting edge in bearing contact therewith, and third force transmitting means formed on an underside of said inner mounting portion and abutting a bearing pad formed integrally on an inboard side of said end wall in bearing contact therewith, and fastening means extending transversely through said inner and outer mounting portions and through said end wall for detachably mounting said adapter on said end wall.

2. The work implement of claim 1 wherein a single said fastening means detachably mounts said adapter on said end wall.

3. The work implement of claim 1 wherein said third force transmitting means is disposed intermediate said first and second force transmitting means in a longitudinal direction along said corner tooth assembly.

4. The work implement of claim 1 wherein said first force transmitting means comprises a flat first bearing surface formed on said adapter portion at the termination of said first slot and intermediate said outer and inner mounting portions and abutting a flat forward edge of said end wall in bearing contact therewith.

5. The work implement of claim 4 wherein said first force transmitting means further comprises a tapered second bearing surface formed rearwardly on said adapter portion to intersect said first bearing surface and maintained in bearing contact formed on a bevelled edge of said cutting edge.

6. The work implement of claim 1 wherein said first force transmitting means comprises a bearing surface formed rearwardly on said adapter portion and abutting a leading edge of said cutting edge and wherein said adapter is maintained out of contact with respect to a forward edge of said end wall.

7. The work implement of claim 1 wherein said second force transmitting means comprises a pair of longitudinally spaced bearing pads formed on a bottom portion of said adapter, secured integrally to said outer mounting portion, and abutting the underside of said cutting edge in bearing contact therewith.

8. The work implement of claim 7 wherein said bearing pads are spaced longitudinally on either side of said fastening means.

9. The work implement of claim 1 wherein said third force transmitting means comprises a flat bearing surface formed on an underside of said inner mounting portion and abutting said bearing pad.

10. The work implement of claim 1 wherein said work implement constitutes a loader bucket and further comprising at least one additional adapter detachably mounted on said cutting edge in laterally spaced relationship relative to said first-mentioned adapter and an earthworking tip detachably mounted on said additional adapter.

* * * * *